US008926075B2

(12) United States Patent
Nose

(10) Patent No.: US 8,926,075 B2
(45) Date of Patent: Jan. 6, 2015

(54) LIQUID CONTAINER

(71) Applicant: Seiko Epson Corporation, Tokyo (JP)

(72) Inventor: Hiroshi Nose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/752,968

(22) Filed: Jan. 29, 2013

(65) Prior Publication Data

US 2013/0321537 A1 Dec. 5, 2013

(30) Foreign Application Priority Data

May 31, 2012 (JP) ..... 2012-124143

(51) Int. Cl.
*B41J 2/175* (2006.01)

(52) U.S. Cl.
CPC .... *B41J 2/17503* (2013.01); *B41J 2002/17573* (2013.01); *B41J 2/17566* (2013.01)
USPC ..... 347/86

(58) Field of Classification Search
CPC ..... B41J 2/17566; B41J 2002/17573; B41J 2/17513
See application file for complete search history.

(56) References Cited

U.S. PATENT DOCUMENTS

| | | | | |
|---|---|---|---|---|
| 5,079,570 | A | 1/1992 | Mohr et al. | |
| 6,454,400 | B1 | 9/2002 | Morita et al. | |
| 6,705,715 | B2 | 3/2004 | Morita et al. | |
| 6,921,161 | B2 | 7/2005 | Morita et al. | |
| 6,942,326 | B2 | 9/2005 | Hayashi et al. | |
| 7,134,747 | B2 | 11/2006 | Hayashi et al. | |
| 2003/0174181 | A1 * | 9/2003 | Nishioka et al. | 347/7 |
| 2011/0234719 | A1 | 9/2011 | Mizutani et al. | |

FOREIGN PATENT DOCUMENTS

| | | | |
|---|---|---|---|
| JP | 02-112948 | A | 4/1990 |
| JP | 03-138158 | A | 6/1991 |
| JP | 11-078042 | A | 3/1999 |
| JP | 2000-071471 | A | 3/2000 |
| JP | 2003-260804 | A | 9/2003 |
| JP | 2004-017599 | A | 1/2004 |
| JP | 2004-122464 | A | 4/2004 |
| JP | 2005-161642 | A | 6/2005 |
| JP | 2011-206936 | A | 10/2011 |

* cited by examiner

*Primary Examiner* — Justin Seo
(74) *Attorney, Agent, or Firm* — Global IP Counselors, LLP

(57) ABSTRACT

A liquid container includes a liquid drain port, a detection chamber, a detection element, a suction portion and a projecting part. The liquid drain port is configured and arranged to supply a liquid to a liquid ejection apparatus. The detection chamber has a bottom surface and a first side wall surface erected from the bottom surface. The detection element is disposed in the detection chamber, and configured and arranged to detect whether or not liquid exists inside the detection chamber. The suction port is provided to the first side wall surface of the detection chamber so that the liquid inside the detection chamber is fed to the liquid drain port via the suction port. The projecting part is provided on the first side wall surface and surrounds at least a part of the suction port.

14 Claims, 4 Drawing Sheets

LIQUID CONTAINER

CROSS-REFERENCE TO RELATED APPLICATIONS

This application claims priority to Japanese Patent Application No. 2012-124143 filed on May 31, 2012, the disclosure of which are hereby incorporated herein by reference in its entirety.

TECHNICAL FIELD

The present invention relates to a liquid container for containing a liquid, the liquid container being mounted onto a liquid ejection apparatus for ejecting a liquid.

BACKGROUND ART

A liquid ejection apparatus, such as a print apparatus, is loaded with a liquid container containing a liquid in the interior, as a supply source of the liquid. The liquid container is loaded into the liquid ejection apparatus so as to be detachable therefrom, and when there is no longer any liquid in the interior, the liquid container can be replaced with a new liquid container.

Techniques for determining whether or not there is liquid inside a container by using a detection element have been proposed, with the purpose of informing a user of the timing for replacing the liquid container. In, for example, a technique disclosed in Japanese Laid-open Patent Application No. 2003-260804, a prism serving as a detection element is installed at a bottom surface of a detection chamber within a liquid container; light is incident on the prism from a light-emitting element, and the reflected light is detected with a light-receiving element. In a state where the surface of the prism is not exposed from the liquid (a state where liquid still remains within the liquid container), the light does not return, and thus light is not detected at the light-receiving element, but when the prism is exposed from the liquid, then the light reflected by the prism is detected at the light-reflecting element. For this reason, depending on whether or not light is detected at the light-receiving element, it is possible to determine whether or not there is liquid inside the liquid container.

SUMMARY

However, in the conventional liquid container described above, in some instances liquid has remained in the interior of the detection chamber, and as a consequence thereof, a problem has emerged in that in some cases it is no longer possible to exhaust the liquid inside the liquid container. Such a problem has the potential to arise not only with a liquid container where an optical detection element, such as a prism, is used, but also similarly in a liquid container where an electrical detection element, such as a piezoelectric element, is used, or where a physical detection element, such as a float, is used.

The present invention has been contrived in order to resolve the above-described problems of the prior art, and an objective thereof is to provide a technique for making it possible to curb the lingering of ink within a detection chamber in a liquid container provided with a detection element that is utilized in order to detect whether or not there is liquid in the interior.

In order to solve the problems described above, at least in part, a liquid container according to one aspect adopts the following configuration. Namely, a liquid container provided with a liquid drain port for supplying a liquid to a liquid ejection apparatus is characterized in being provided with: the liquid drain port, which supplies the liquid to the liquid ejection apparatus; a detection chamber having a bottom surface as well as a first side wall surface erected from the bottom surface, the detection chamber being provided within the liquid container; a detection element that is utilized in order to detect whether or not there is liquid in the interior, the detection element being provided to the detection chamber; and a suction port provided to the first side wall surface of the detection chamber; the liquid inside the detection chamber being fed to the liquid drain port via the suction port, and a projecting part that surrounds at least a part of the suction port being provided on the first side wall surface.

In the liquid container according to this aspect, the liquid level inside the detection chamber falls in association with the suction of the liquid inside the detection chamber by the liquid ejection apparatus, but at the portion where the suction port is, the liquid attaches to the projecting part provided so as to surround a part thereof, and therefore a state where the suction port is covered with the liquid is maintained. As such, the liquid can be suctioned until the liquid level reaches the bottom surface of the detection chamber. As a result, it becomes possible to curb lingering of the liquid inside the detection chamber.

In the liquid container of the aspect described above, preferably, the suction port is provided in the vicinity of a corner that is constituted of the bottom surface and the first side wall surface of the detection chamber. Particularly preferably, the detection chamber has a second side wall surface that is erected from the bottom surface and is adjacent to the first side wall surface, and the suction port is provided to the vicinity of a corner that is constituted of the bottom surface, the first side wall surface, and the second side wall surface of the detection chamber.

The corner constituted of the side wall surface(s) and the bottom surface is more prone to gather the liquid. The corner constituted of the two side wall surfaces and the bottom wall surface is particularly prone to gather the liquid. For this reason, in having the suction port be provided to such a location/such locations, the suction port is more readily maintained in a state of being covered with the liquid. As a result, due to the fact that the liquid is suctioned from the suction port, it becomes possible to reliably suppress lingering of the liquid inside the detection chamber.

In the liquid container of the aspect described above, the projecting part may be provided in a state where one side is in contact with the second side wall surface.

In so doing, not only will the liquid broaden running along the lower surface of the projecting part from the first side wall surface, but also the liquid will broaden running along the lower surface of the projecting part from the second side wall surface, and thus the suction port is more readily maintained in a state of being covered with the liquid. As a result, due to the fact that the liquid is suctioned from the suction port, it becomes possible to reliably suppress lingering of the liquid inside the detection chamber.

In the liquid container of the aspect described above, a gap may be formed between a distal end of the projecting part, which is provided projecting from the first side wall surface, and a third side wall surface, which is provided so as to face the first side wall surface within the detection chamber. In so doing, the liquid can also be oriented toward the suction port from above the projecting part, via the gap, and thus it becomes possible for the liquid to be more readily suctioned from the suction port.

In the liquid container of the aspect described above, the suction port may be formed in a circular shape, and the projecting part may be formed in a circular tubular shape of the same inner diameter as that of the suction port, this shape being open on a side surface of a side not in contact with the second side wall surface. In so doing, the suction port and the projecting part can be integrally formed, and thus it is easier to form the suction port and the projecting part.

In the liquid container of the aspect described above, an opening portion of the projecting part may be formed so that the height from the bottom surface of the detection chamber becomes increasingly lower approaching the suction port.

In so doing, the opening portion of the side surface of the projecting part can be narrowed going toward the suction port. As a result, the liquid can be moved toward the narrower side (the direction of the suction port) by capillary force acting on the opening portion of the side surface of the projecting part, and thus it becomes possible to curb lingering of the liquid inside the detection chamber.

In the liquid container of the aspect described above, the detection element may be a prism provided to the bottom surface of the detection chamber, and the opening portion of the side surface of the projecting part may be set so that the height, from the bottom surface, of the opening portion at a position closest to the suction port is made to be smaller than the height from the bottom surface at a position corresponding to a position where the prism reflects light. In so doing, the suction port can be placed in a state of being covered with the liquid while the liquid is being detected by the prism. For this reason, with the prism, an event where the liquid can no longer be suctioned can be avoided, regardless of whether the liquid is being detected or not.

In the liquid container of the aspect described above, the detection element may be a prism provided to the bottom surface of the detection chamber, and the opening portion of the side surface of the projecting part may be set so that the height, from the bottom surface of the detection chamber, of the opening portion at a position farthest from the suction port is made to be greater than the height from the bottom surface of the detection chamber at a position corresponding to a position where the prism reflects light.

The projecting part provided above the suction port has a function for maintaining a state where below the suction port is covered with the liquid, by causing the liquid to attach. In some instances, a part of the suction port is exposed from the liquid level even in a case where a comparatively greater amount of liquid remains, because the liquid container, having been mounted onto the liquid ejection apparatus, is often used while also moving reciprocatingly, and the liquid level inside the liquid container shakes. Even in such cases, the liquid can still be reliably suctioned from the suction port, because the liquid can be retained at the projecting part from a stage where the liquid level is higher than the position where the light is reflected by the prism, and the suction port can be maintained in a state of being covered with the liquid.

DESCRIPTION OF THE EMBODIMENTS

The following describes an example, in the sequence as follows, in order to clarify the features of the present invention described above: A. Apparatus configuration; B. Structure of the ink cartridge; and C. Reasons why it is possible to curb the lingering of ink within the detection chamber.

A. Apparatus Configuration

Figure 1:
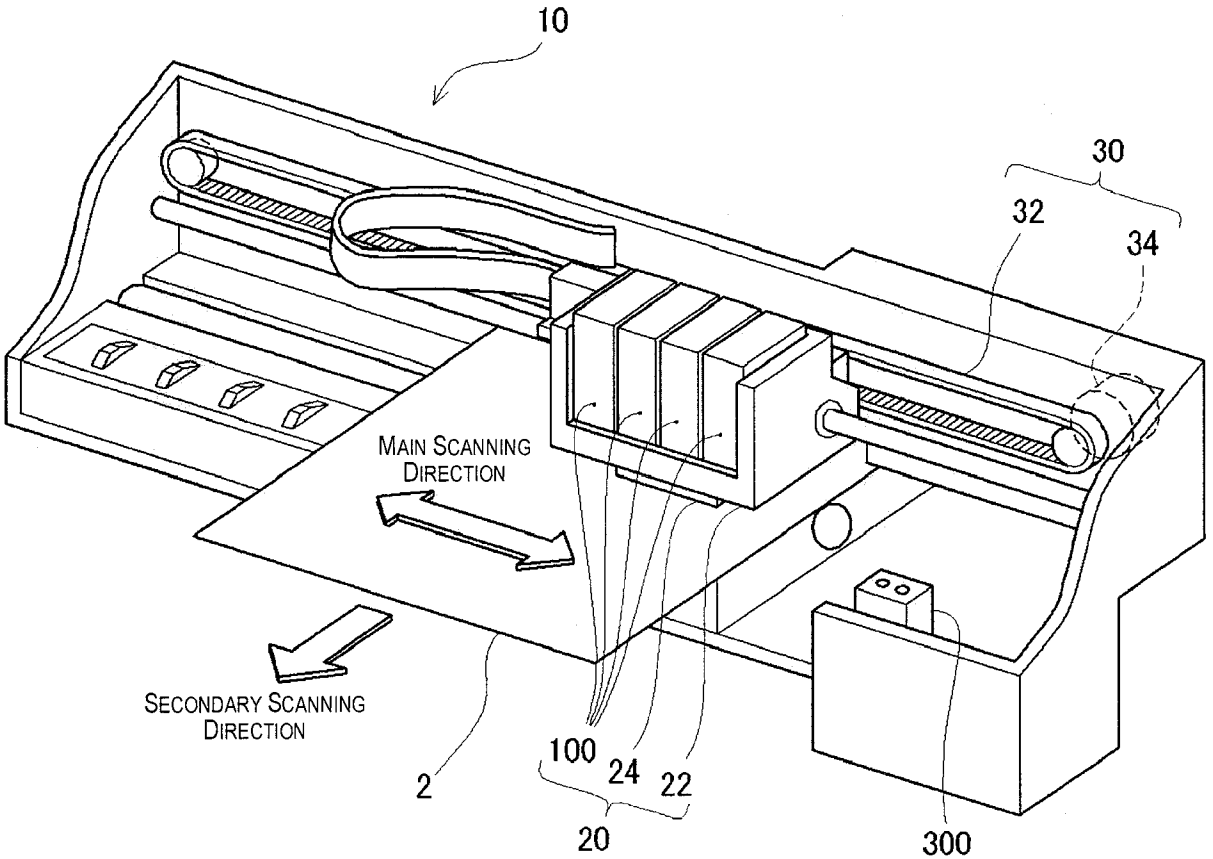
FIG. 1 is a descriptive diagram illustrating a general configuration of a liquid ejection apparatus of the present embodiment.

FIG. 1 is a descriptive diagram illustrating the general configuration of the liquid ejection apparatus of the present embodiment, using a so-called inkjet printer by way of example. As is depicted, an inkjet printer 10 is constituted of a carriage 20 for forming ink dots on a print paper 2 while also moving reciprocatingly in a main scanning direction, a drive mechanism 30 for reciprocatingly driving the carriage 20, and the like. Provided to the carriage 20 are ink cartridges 100 which contain ink, a carriage case 22 onto which the ink cartridges 100 are mounted, an ejecting head 24 for ejecting the ink, and the like. A plurality of nozzles are provided to a bottom surface side of the ejecting head 24 (the side that faces the print paper 2); the ink inside the ink cartridges 100 is guided to the ejecting head 24, allowing for the ink to be ejected from the nozzles onto the print paper 2.

In the inkjet printer 10 that is depicted, a color image can be printed by using four types of ink, i.e., cyan-colored, magenta-colored, yellow-colored, and black-colored ink; in correspondence thereto, nozzles are provided to the ejecting head 24 for each of the types of ink. The inks are supplied to each of the nozzles from the corresponding ink cartridge 100 via a passage (not shown).

The drive mechanism 30 for reciprocatingly driving the carriage 20 is constituted of a timing belt 32 on the inside of which a plurality of tooth marks are formed, a drive motor 34 for driving the timing belt 32, and the like. A part of the timing belt 32 is fixed to the carriage case 22, and when the timing belt 32 is driven, the carriage 20 can be reciprocatingly driven in the main scanning direction while also being guided by a guide rail provided extending in the main scanning direction.

A detection unit 300 for optically detecting whether or not there is ink inside the ink cartridges 100, or, to be more precise, inside a detection chamber provided to the interior of the ink cartridges 100 is provided to a position other than a print region of the inkjet printer 10. A more detailed description will follow, but a light-emitting unit and a light-receiving unit are provided to the interior of the detection unit 300; light is emitted from the light-emitting unit when the ink cartridges 100 pass over the detection unit 300 in association with the movement of the carriage 20; the presence or absence of ink inside the ink cartridges 100, or, to be more precise, inside the detection chamber provided to the interior of the ink cartridges is detected depending on whether or not the light is received by the light-receiving unit.

B. Structure of Ink Cartridge

Figure 2:
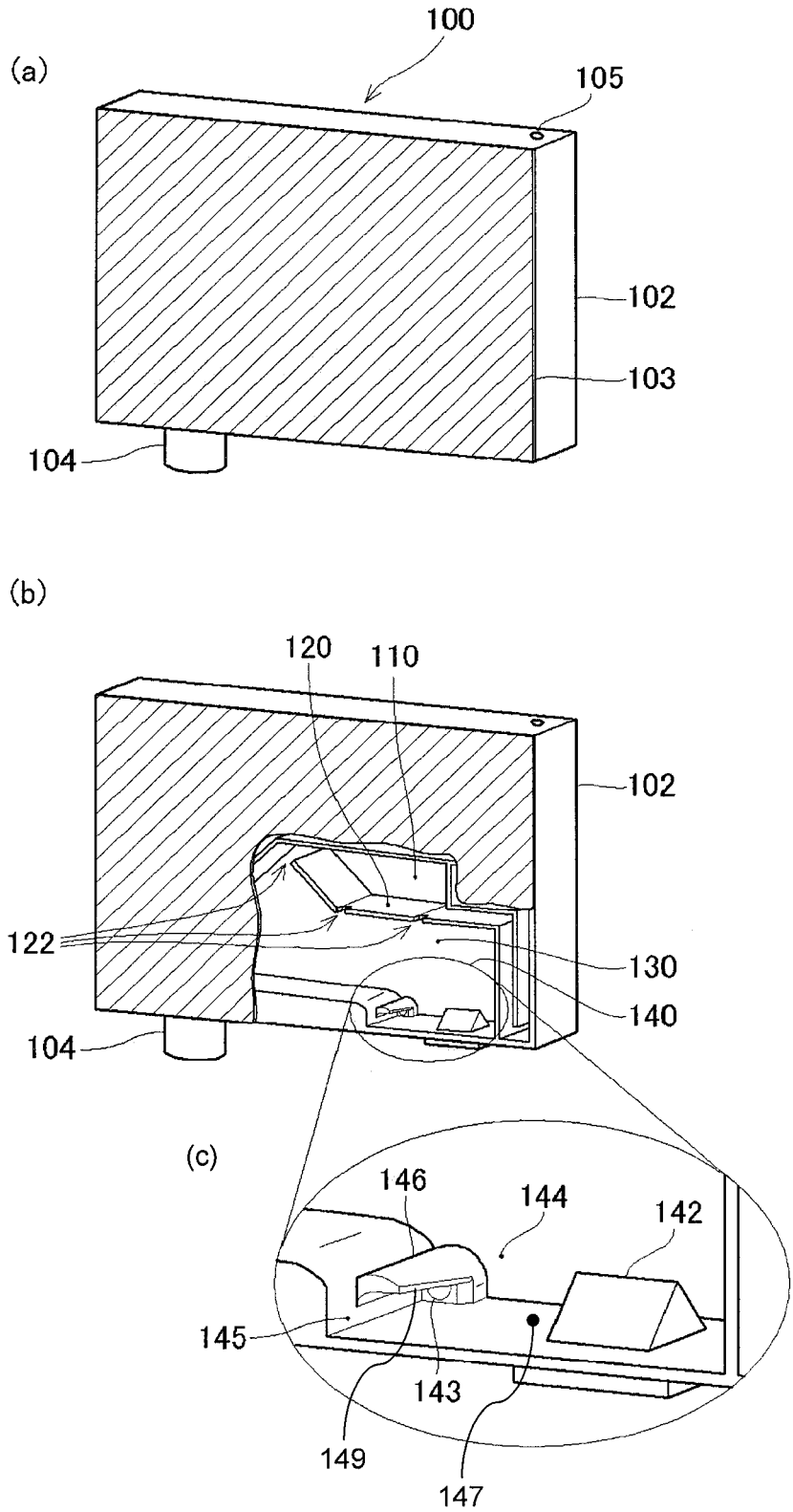
FIG. 2 includes a diagram (a), which is a perspective view illustrating a structure of an ink cartridge of the present embodiment; a diagram (b), which is a perspective view illustrating a part of an internal structure of the ink cartridge of the present embodiment; and a diagram (c), which is a partially enlarged view of FIG. 2(*b*)

FIG. 2 is a perspective view illustrating the structure of the ink cartridges 100 of the present embodiment. As illustrated in FIG. 2(*a*), the ink cartridges 100 are constituted of a body case 102 formed of a hard resin material, a film 103 for covering a side surface of one side of the body case 102, and the like. Provided to a bottom surface is an ink drain port 104 for supplying the ink to the ejecting head 24. Provided to an upper surface is an air inlet 105 for drawing air into the inside of the ink cartridges 100, in association with the consumption of the ink inside the ink cartridges 100.

FIG. 2(*b*) illustrates one part of the interior structure of the ink cartridges 100 of the present embodiment, by breaking the film 103. FIG. 2(*c*) is an enlarged illustration of a portion belonging to a detection chamber 140 within the interior structure of the ink cartridges 100 illustrated in FIG. 2(*b*). Ink chambers 110, 130 are provided to the interior of the ink cartridges 100. The ink chambers 110, 130 are partitioned in two by a barrier wall 120. A first ink chamber 110 is formed on an upper side of the barrier wall 120, and a second ink chamber 130 is formed on a lower side of the barrier wall 120. The detection chamber 140 is formed at a bottom part of the ink cartridges 100, at a place that is lower than a bottom surface of the ink chamber 130. As illustrated in FIG. 2(*c*), the detection chamber 140 has a bottom surface 147 and a first side wall surface 144 erected from the bottom surface 147. The detection chamber 140 also has a second side wall surface 145 that is erected from the bottom surface 147 and is adjacent to the first side wall surface 144. A prism 142, serving as a detection element that is utilized in order to detect whether or not there is ink, is provided to the bottom surface 147 of the detection chamber 140. The prism 142 is inlaid into an opening part provided to the bottom wall of the ink cartridges 100. Light is permitted to be incident on the bottom surface of the prism 142 from the light-emitting unit of the detection unit 300. The prism 142 is provided to a position of the bottom surface of the ink cartridges 100 that is separated from the ink drain port 104. That is, the prism 142 is provided to a position that is deviated toward one side wall (in FIG. 2(*b*), this is the right-side side wall) of the two side walls that intersect with the bottom surface of the ink cartridges 100 and face each other; the ink drain port 104 is provided to a position that is deviated toward the other side wall (in FIG. 2(*b*), this is the left-side side wall. Herein, providing the prism 142 to a position that is separated from the ink drain port 104 makes it possible to prevent ink, having leaked out from the ink drain port, from attaching to the vicinity of the prism 142 and becoming a hindrance to detection.

The first ink chamber 110 and the second ink chamber 130 communicate with each other by communication ports 122 provided to a plurality of places (in the present embodiment, three places) of the barrier wall 120. The first ink chamber 110 also communicates with the air inlet 105 via an interconnecting passageway or an ink chamber provided upstream of an interconnecting passageway as well as via an air passageway or the like. Additionally, the detection chamber 140 communicates with the ink drain port 104 of the bottom surface of the body case 102 via a suction passageway (not shown) and a suction port 143 provided to the bottom part of the detection chamber 140. A variety of modes that are known in the art could be adopted as a flow path configuration for communicating the ink chamber 110 and the air inlet 105 to each other and as a flow path configuration for communicating the detection chamber 140 and the ink inlet 104 to each other, and therefore a more detailed depiction and description thereof is omitted herein. In the ink cartridges 100 of the structure of such description, when ink flows out to the ejecting head 24 from the ink drain port 104, first the ink inside the ink chambers is consumed, and thereafter the ink inside the detection chamber 140 is consumed. In an ink cartridge in which an ink chamber is constituted of a plurality of ink chambers, as in the ink cartridges 100 of the present embodiment, in a case where the air inlet 105 side is the upstream side and the ink drain port 104 side is the downstream side, then the ink is consumed in sequence from the ink inside the ink chamber(s) on the upstream side, and after the ink inside the ink chamber on the most downstream side is consumed, then the ink inside the detection chamber 140 is consumed. In the present embodiment, the first ink chamber 100 is provided further upstream than the second ink chamber 130, and therefore the ink is consumed from the first ink chamber, the second ink chamber, and the detection chamber 140, in the stated order.

In the ink cartridges 100 of the present embodiment, a projecting part 146 that surrounds at least a part of the suction port 143 of the detection chamber 140 is provided. In the present embodiment, the projecting part 146 is provided above the suction port 143. The projecting part 146 is provided atop a side wall surface (a first side wall surface) 144 on a back side of the detection chamber 140. The projecting part 146 is formed in a substantially circular tubular shape of the same inner diameter as that of the suction port 143. A vacant gap exists between a distal end of the projecting part 146 and a side wall surface (a surface constituted of an inner surface of the film 103; a third side wall surface) 148 of a front side of the detection chamber 140. One side of the projecting part 146 is in contact with the left-side side wall surface (second side wall surface) 145 of the detection chamber 140, and a side surface on the side where the projecting part 146 is not in contact with the second side wall surface 145 is open. Additionally, this opening portion 149 of the projecting part 146 is formed so that the height from the bottom surface 147 of the detection chamber 140 is increasingly lower approaching the suction port 143 (i.e., the height from the bottom surface 147 decreases as a distance to the suction port 143 decreases).

C. Manner in Which Ink Inside Detection Chamber is Suctioned

Figure 3:
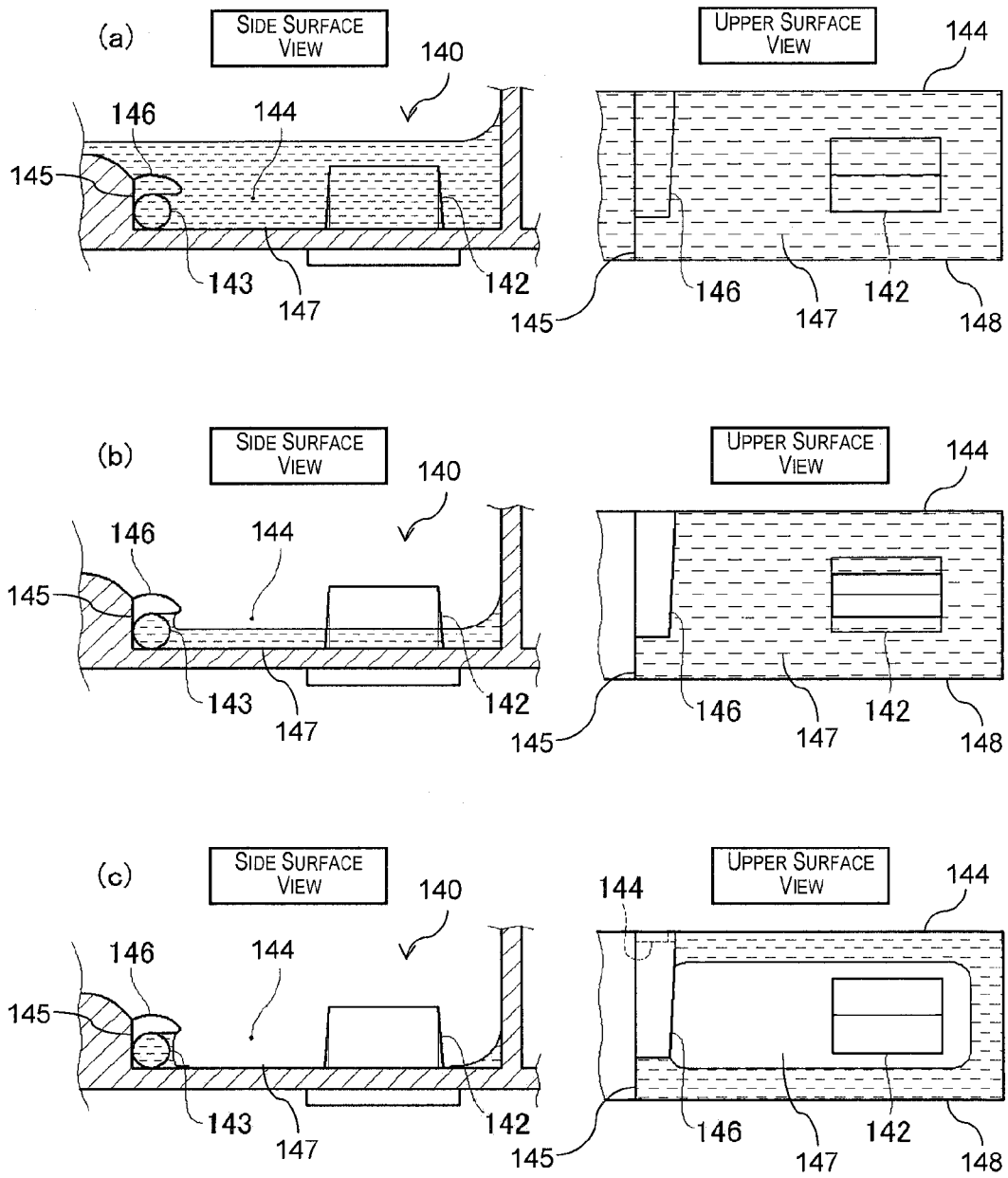
FIG. 3 includes diagrams (a) to (c), which are descriptive diagrams illustrating the manner in which ink inside a detection chamber is suctioned.

FIG. 3 is a descriptive diagram illustrating the manner in which the ink inside the detection chamber 140 is suctioned. FIG. 3(*a*) illustrates the appearance of the interior of the detection chamber 140 as seen from the film 103 side of the ink cartridges 100, and FIG. 3(*b*) illustrates the appearance of the interior of the detection chamber 140 illustrated in FIG. 3(*a*) as seen from above.

As illustrated in FIG. 3(*a*), in a state where the ink is amply present inside the detection chamber 140, the ink inside the detection chamber 140 is sucked out from the suction port 143. When the ink is sucked out and the liquid level of the ink inside the detection chamber 140 descends, eventually the ink liquid level will fall below an upper end part of the suction port. Herein, in the ink cartridges 100 of the present embodiment, the projecting part 146 is provided so as to surround a part of the suction port 143. For this reason, as illustrated in FIG. 3(*b*), even when the ink level falls below the upper end part of the suction port 143, the ink attaches to the projecting part 146, and this maintains the state where the suction port 143 is covered with the ink. The continuous sucking out of the ink in this state allows for the ink to be suctioned out until, as illustrated in FIG. 3(*c*), the ink liquid level reaches the bottom surface 147 of the detection chamber 140.

At the stage where the ink liquid level has reached the bottom surface 147 of the detection chamber 140, there is ink lingering alongside the walls of the detection chamber 140 (see FIG. 3(*c*)). In the ink cartridges 100 of the present embodiment, the suction port 143 is provided alongside the wall of the detection chamber 140, and thus even after the ink liquid level has reached the bottom surface 147 of the detection chamber 140, the ink alongside the walls of the detection chamber 140 can still be suctioned from the suction port 143. In order to obtain such an effect, preferably, the suction port 143 is provided in the vicinity of a corner constituted by the bottom surface 147 and the first side wall surface 144 of the detection chamber 140. Even more preferably, the suction port 143 is provided in the vicinity of a corner constituted by the bottom surface 147, the first side wall surface 144, and the second wall surface 145 of the detection chamber 140.

Figure 4:
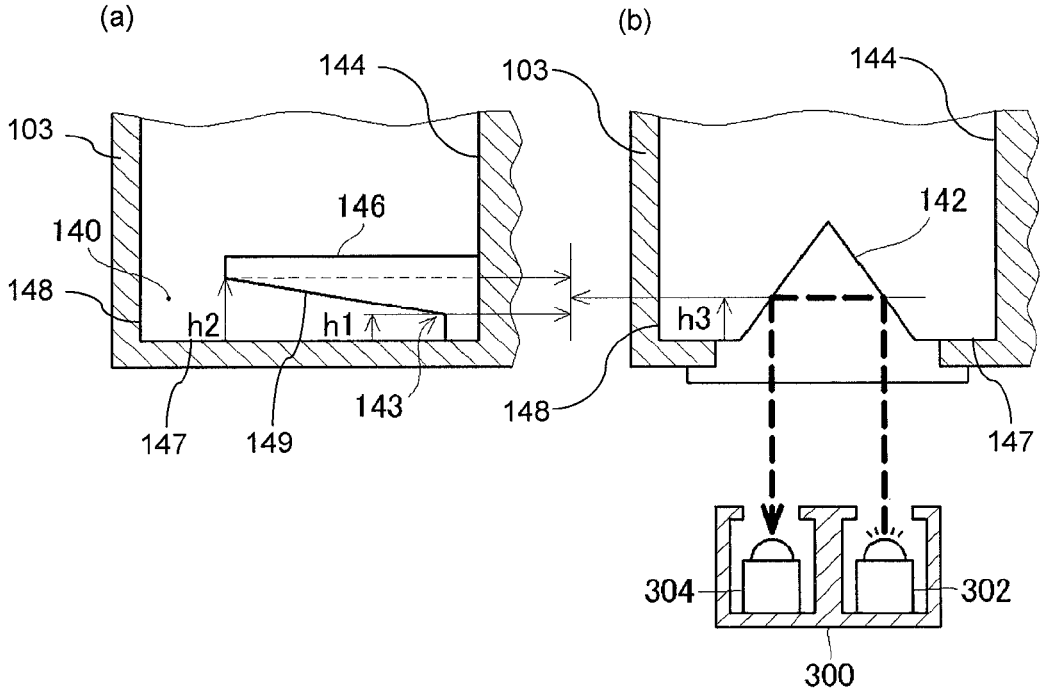
FIG. 4 includes a diagram (a), which is a descriptive diagram illustrating the appearance of a suction port and a projecting part within a prism chamber detection chamber as seen from the side, and a diagram (b), which is a descriptive diagram illustrating the appearance of a prism as seen from the side, as well as the manner in which light that is incident on the prism from a light-emitting unit of a detection unit is reflected at a detection position and travels toward a light-receiving unit.

FIG. 4(*a*) illustrates the appearance of the suction port 143 and the projecting part 146 inside the detection chamber 140 as seen from the side. As illustrated in FIG. 4(*a*), a vacant gap exists between the distal end of the projecting part 146 and the side wall surface (third side wall surface) 148 of the front side of the detection chamber 140. For this reason, because the ink can be oriented toward the suction port 143 from above the projecting part 146, too, via the gap, it is easy to suction the ink out from the suction port 143. As illustrated in FIGS. 3(*a*) to 3(*c*), in the ink cartridges 100 of the present embodiment, the suction port 143 is formed in a circular shape, and the projecting part 146 is formed in a substantially circular tubular shape of the same inner diameter as that of the suction port 143. So doing makes it possible for the suction port 143 and the projecting part 146 to be integrally formed, and thus it is easy to form the suction port 143 and the projecting part 146.

In the ink cartridges 100 of the present embodiment, as illustrated in FIG. 4(*a*), the opening portion 149 of the projecting part 146 is formed so that the height from the bottom surface 147 of the detection chamber 140 becomes lower approaching the suction port 143 (see FIG. 2(*c*)). Because the opening portion 149 narrows toward the suction port 143, this makes it possible to move the ink to the narrow side (toward the suction port 143) due to the capillary force acting on the opening portion 149. As a result, it becomes possible to curb the lingering of the ink inside the detection chamber 140.

Additionally, in the ink cartridges 100 of the present embodiment, the height from the bottom surface 147 of the detection chamber 140 at the opening portion 149 of the side surface of the projecting part 146 is set as follows in terms of a relationship with a light reflection position of the prism 142. Below is a supplementary explanation on this feature.

FIGS. 4(*a*) and 4(*b*) illustrate a positional relationship between the height from the bottom surface 147 of the detection chamber 140 at the opening portion 149 of the side surface of the projecting part 146 and the light reflection position of the prism 142. FIG. 4(*a*) illustrates the appearance of the suction port 143 and the projecting part 146 of the detection chamber 140 as seen from the side, and FIG. 4(*b*) illustrates the appearance of the prism 142 as seen from the side. FIG. 4(*b*) uses a dashed line to illustrate the manner in which light that is incident on the prism 142 from the light-emitting unit 302 of the detection unit 300 is reflected at a detection position and travels toward the light-receiving unit 304.

As illustrated in FIGS. 4(*a*) and 4(*b*), in the ink cartridges 100 of the present embodiment, a height h1 from the bottom surface 147 at the opening portion 149 of the projecting part 146 at a position closest to the suction port 143 is set so as to be smaller than a height h3 to the light reflection position of the prism 142. When the heights are set in this manner, the suction port 143 can be placed in a state of being covered with ink while the presence of ink is being detected with the prism 142. As a result, with the prism 142, an event where ink can no longer be suctioned out can be avoided, regardless of whether the presence of ink is being detected.

As illustrated in FIGS. 4(*a*) and 4(*b*), in the ink cartridges 100 of the present embodiment, a height h2 from the bottom surface 147 at the opening portion 149 of the projecting part 146 in a position farthest from the suction port 143 is set so as to be greater than the height h3 to the light reflection position of the prism 142. In so doing, the ink can be held at the projecting part 146 from the stage where the liquid level is higher than the position at which the light is reflected by the prism 142, and the suction port 143 can be kept in the state of being covered with ink. For this reason, in the state where a relatively large amount of ink remains, the liquid level inside the detection chamber 140 is swayed by the reciprocating movement of the ink cartridges 100, and this makes it possible to avoid exposure of a part of the suction port 143 from the liquid level. As a result, it becomes possible to reliably suction the ink from the suction port 143.

A variety of embodiments have been described above; however, the present invention is in no way limited to the foregoing embodiments, and implementation in a variety of modes is possible within a scope not departing from the spirit thereof.

The invention claimed is:

1. A liquid container configured to be loaded into a liquid ejection apparatus, the liquid container, comprising:

a detection chamber having at least a bottom surface, a first side wall surface, a second side wall surface, and a third side wall surface when the liquid container is loaded into the liquid ejection apparatus, the first side wall surface, the second side wall surface, and the third side wall surface being erected from the bottom surface, the first side wall surface facing the third side wall surface;

a liquid drain port configured and arranged to supply a liquid in a first direction from the liquid container to the liquid ejection apparatus, a detection element disposed in the detection chamber, and configured and arranged to detect liquid inside the detection chamber;

a suction port provided on the bottom surface in the detection chamber, the suction port being formed on the first side wall surface, the suction port being opened to the detection chamber in a second direction from the first side wall surface toward the third side wall surface, the second direction being perpendicular to the first direction; and a suction passageway configured to feed the liquid inside the detection chamber to the liquid drain port, the liquid drain port and the suction port being communicated via the suction passageway.

2. The liquid container as set forth in claim 1, wherein the suction port is disposed in the vicinity of the corner formed by the bottom surface, the first side wall surface, and the second side wall surface in the detection chamber.

3. The liquid container as set forth in claim 1, further comprising a projecting part projected from the first side wall surface toward the third side wall surface, the projecting part surrounding at least a part of the suction port.

4. The liquid container as set forth in claim 1, further comprising:

a projecting part projected from the first side wall toward the third side wall surface, the projecting part surrounding at least a part of the suction port, one side of the projecting part contacting the second side wall surface, the suction port being disposed in the vicinity of the corner formed by the bottom surface, the first side wall surface, and the second side wall surface in the detection chamber.

5. The liquid container as set forth in claim 1, further comprising a projecting part surrounding at least a part of the suction port, the projecting part projecting along the second direction from the first side wall surface.

6. The liquid container as set forth in claim 3, wherein the projecting part has a bottom side surface, the bottom side surface faces the bottom surface with respect to each other in the first direction, the bottom side surface extends from the first side wall surface such that the bottom side surface gradually departs from the bottom surface as the bottom side surface departs from the first side wall surface.

7. The liquid container as set forth in claim 1, wherein the third side wall surface is formed by a film.

8. The liquid container as set forth in claim 3, wherein one side of the projecting part contacts the second side wall surface.

9. The liquid container as set forth in claim 4, wherein a gap is formed between a distal end of the projecting part projecting from the first side wall surface, and the third side wall surface.

10. The liquid container as set forth in claim 4, wherein the suction port has a circular shape.

11. The liquid container as set forth in claim 10, wherein the projecting part has a circular tubular shape having the same inner diameter as that of the suction port, the circular tubular shape being open on a side surface of the projecting part that is not in contact with the second side wall surface.

12. The liquid container as set forth in claim 11, wherein an opening portion of the projecting part is arranged so that a height from the bottom surface decreases as a distance to the suction port decreases.

13. The liquid container as set forth in claim 12, wherein the detection element is a prism provided to the bottom surface of the detection chamber, and the opening portion of the side surface of the projecting part is arranged so that the height from the bottom surface at a position closest to the suction port is smaller than the height from the bottom surface at a position corresponding to a position where the prism reflects light.

14. The liquid container as set forth in claim 12, wherein the detection element is a prism provided to the bottom surface of the detection chamber, and the opening portion of the side surface of the projecting part is arranged so that the height from the bottom surface at a position farthest from the suction port is greater than the height at a position corresponding to a position where the prism reflects light.

* * * * *